US009903586B2

(12) United States Patent
Blotter

(10) Patent No.: US 9,903,586 B2
(45) Date of Patent: Feb. 27, 2018

(54) WASTE OIL BURNER

(71) Applicant: Marty Blotter, Diamond, MO (US)

(72) Inventor: Marty Blotter, Diamond, MO (US)

( * ) Notice: Subject to any disclaimer, the term of this patent is extended or adjusted under 35 U.S.C. 154(b) by 523 days.

(21) Appl. No.: 14/567,394

(22) Filed: Dec. 11, 2014

(65) Prior Publication Data

US 2016/0091202 A1 Mar. 31, 2016

Related U.S. Application Data

(60) Provisional application No. 61/915,741, filed on Dec. 13, 2013.

(51) Int. Cl.

| | |
|---|---|
| ***F23G 7/05*** | (2006.01) |
| ***F23G 5/32*** | (2006.01) |
| ***F23G 5/44*** | (2006.01) |

(52) U.S. Cl.

CPC ..... *F23G 7/05* (2013.01); *F23G 5/32* (2013.01); *F23G 5/446* (2013.01); *F23G 2209/102* (2013.01)

(58) Field of Classification Search

CPC ... F23G 7/04; F23G 7/05; F23G 7/008; F23G 5/446; F23G 5/20; F23G 2209/10; F23G 2209/101; F23G 2209/102

See application file for complete search history.

(56) References Cited

U.S. PATENT DOCUMENTS

| | | | | |
|---|---|---|---|---|
| 3,513,788 | A * | 5/1970 | Ostrin | F23G 5/20 110/246 |
| 3,856,455 | A | 12/1974 | Otway et al. | |
| 4,033,505 | A | 7/1977 | Lutes et al. | |
| 4,565,137 | A | 1/1986 | Wright | |
| 4,584,948 | A | 4/1986 | Syred et al. | |
| 5,220,888 | A | 6/1993 | Khinkis et al. | |
| 6,202,578 | B1 | 3/2001 | Ruottu et al. | |
| 6,453,830 | B1 | 9/2002 | Zauderer | |
| 6,910,432 | B2 | 6/2005 | D'Agostini et al. | |
| 7,261,047 | B2 | 8/2007 | Ljungdahl | |
| 7,553,463 | B2 | 6/2009 | Zauderer | |
| 2004/0241602 | A1 | 12/2004 | Bechard | |
| 2006/0201405 | A1 | 9/2006 | Devault et al. | |
| 2010/0062384 | A1 | 3/2010 | Lavoie | |
| 2010/0307390 | A1 | 12/2010 | Miller | |
| 2012/0148964 | A1 | 6/2012 | Haynes | |
| 2013/0000533 | A1 | 1/2013 | Leue | |
| 2013/0206046 | A1 | 8/2013 | Jones | |

FOREIGN PATENT DOCUMENTS

| | | |
|---|---|---|
| KR | 1020120116609 | 10/2012 |

OTHER PUBLICATIONS

International Search Report and Written Opinion from Corresponding PCT Patent Application PCT/US2015/042464 dated Feb. 25, 2016; Korean Intellectual Property Office.

"Secondary Combustion Air Flow Measurement in Cyclone Burners", Thermo Brandt, 2011, Seelaus Instrument Company, Inc.

* cited by examiner

*Primary Examiner* — David J Laux

(74) *Attorney, Agent, or Firm* — Head, Johnson, Kachigian & Wilkinson, PC

(57) ABSTRACT

A liquid fuel combustion device that utilizes waste and contaminated oils without the need for pre-processing or filtering the fuel stock.

13 Claims, 7 Drawing Sheets

WASTE OIL BURNER

CROSS REFERENCE

This application is based on and claims priority to U.S. Provisional Patent Application No. 61/915,741 filed Dec. 13, 2013.

BACKGROUND OF THE INVENTION

Field of the Invention

This invention relates generally to a waste oil burner, and more particularly, but not by way of limitation, to a liquid fuel combustion device specifically designed to utilize waste and contaminated used oils without the need for pre-processing or filtering the fuel stock. The device relates to the general category of liquid fuel burners that employ vortex flow conditions in the combustion zone.

Description of the Related Art

The prior art concerning liquid fuel burners includes many methods and combinations of those methods of introducing fuel vapor or small fuel droplets into a combustion air stream. These methods represent an effort to reduce fuel droplet size and increase mixing accuracy and homogeneity with the combustion air. Vaporization methods are limited to light fuel oils with a tightly controlled viscosity range for a specific burner type. Heavy fuels burners utilize some method of droplet generation and distribution. Since fuel droplets have a liquid volume and combustion occurs at the surface of the droplet, the surface area to volume ratio of the fuel droplet is critical for efficient combustion. Large droplet sizes take longer to completely burn and are difficult to retain in the combustion zone until completely burned. Smoke and soot formation result. The fuel droplet volume is proportional to the cube of its diameter and the droplet surface area is proportional to the square of the diameter therefor the smaller the droplet size the better. There are practical limitations for reducing droplet size, and the heavier the fuel the larger is the limiting size. Droplet size consistency is also critical and requires careful maintenance of high quality machinery. None of the current methods is well suited to fuels of variable quality and viscosity or wide ranges of viscosity. Nor are they suitable for contaminated or particulate laden waste fuels.

A summary of the types of fuel delivery and combustion air mixing methods includes: surface vaporization by combustion heat from the surface of a pool of fuel or a wick into a convection of forced air draft (suitable for light low viscosity fuels only), pressurized fuel spray through a nozzle directly into a forced or natural convection air stream, pressurized and preheated fuel sprayed through a nozzle directly into a forced or natural convection air stream, pressurized fuel sprayed through an atomizing nozzle utilizing high temperature steam or compressed air to tear apart the liquid oil and spray it into the air stream, and use of a centrifugal slinger to spread the fuel into a thin film before it flings off into the supplied air stream. All of these methods require their particular combination of tanks, pumps, filters, preheaters, nozzles, and blowers to service carefully shaped combustion chambers for their specific combustion characteristics. Achieving efficient combustion with these methods is typically a delicate balance requiring precise adjustments of the pressures, temperatures, and flow rates of the fuel and air. Frequently, specialized electronic controls are necessary to maintain proper combustion, or else frequent physical monitoring and manual adjustment are required. Air and combustion flow in the burners occupy a range from slow, linear and laminar to fast, cyclonic, and turbulent. Burners can incorporate a series of stages incorporating any of these flow regimes to achieve the desired combustion properties. Multiple stage combustion is produced by additional combustion airstreams admitted downstream from the primary combustion zone.

All of these variables are typically tailored to the particular heat production requirements for a particular fuel type in a particular environment in an effort to control emissions, combustion temperatures, heat output rate, and ash formation. The resulting high specificity and tightly restricted operating parameters of the designs makes them impractical or unsuitable for dealing with the variable nature of unprocessed waste fuel sources.

Based on the foregoing, it is desirable to provide a simple robust burner system to be fueled by any liquid based waste fuels in an as-is unprocessed state. This is purposed in order to achieve maximum economic value from waste liquid fuel stocks, and to safely eliminate environmental hazards that would be impractical to recycle or dispose of, thus rendering them an economic advantage.

It is further desirable to provide such a system with stable consistent combustion characteristics across the entire range of fuels and burn rates.

It is further desirable to provide simplicity of design and scalability incorporated throughout to produce a practical device. This is purposed in order to allow economical operation from small scale consumer applications to large scale industrial ones.

It is further desirable to provide robust design capable of durable long-life function in adverse conditions without need for adjustment, tuning, or technical support and maintenance.

It is further desirable to provide adjustable heat output rate to allow more efficient continuous operation tailored to the demand as compared to common full-on/full-off output regulation.

It is further desirable to provide separation of ash in small particle form from the flue gasses internal to the burner, continually collected in an ash reservoir, and self-cleaning operation.

It is further desirable to provide control of peak temperatures to prevent formation of nitrogen oxides.

It is further desirable to provide leakage safe positive pressure combustion coupled with low external operating temperatures for fire safety.

It is further desirable to provide fuel supplied at low pressure without preheating or filtration to allow use of particulate laden and slurried fuels.

It is further desirable to provide easy application to a wide variety of heating applications including furnaces, boilers, and industrial processes.

SUMMARY OF THE INVENTION

In general, in a first aspect, the invention relates to a waste oil fuel burner comprising: a plenum; a pre-combustion chamber located within the plenum; a disc located within the pre-combustion chamber, where the disc has a first surface, an opposing second surface, an edge, and a center; a drive shaft extending into the plenum upon which the pre-combustion chamber and the disc are mounted, allowing the pre-combustion chamber and the disc to rotate within the plenum; a fuel supply tube located such that the fuel supply tube is capable of applying liquid fuel to the first surface of the disc near the center of the disc; and an igniter. The burner may further comprise a combustion blower attached to the plenum via a tangential flow air supply port and/or an ash collector and dump valve, where the ash collector is attached to the plenum.

The burner may further comprise a mounting plate attached to a first end of the plenum and a drive end cover attached to an opposing second end of the plenum. The mounting plate may have an exhaust port comprising a combination exhaust tube and ash deflector. The drive shaft and fuel supply tube may extend through the drive end cover. A fuel supply frame and a drive motor may be attached to the drive end cover, such that the drive shaft attaches to the drive motor via a heat sink shaft coupler and the fuel supply tube, the igniter, and an igniter gas supply tube fit into the fuel supply frame. The igniter may be a silicone nitride hot surface igniter.

The pre-combustion chamber may not be physically attached to the disc such that it hangs from and rolls on the edge of the disc in an epicyclic fashion. The pre-combustion chamber may further comprise a plurality of disc surface scraper pins extending toward the first surface of the disc such that the pins cause an orbital and precessional scraping pattern that completely and uniformly covers the first surface of the disc when the disc is rotated. The disc may further comprise a plurality of pre-combustion chamber scraper pins extending from the second surface of the disc.

The fuel supply tube may be attached to a pulsed flow peristaltic pump comprising peristaltic tubing squeezed between a fixed platen and a driven platen by an electric solenoid and two check valves establishing directional flow.

The invention further relates to a method of combusting waste oil fuel. The method comprises first rotating a vertical disc located within a pre-combustion chamber, where the disc has a first surface and an opposing second surface and the pre-combustion chamber is located within a plenum. The next step is applying fuel to the first surface of the disc near the center, where the fuel comprises a highly volatile portion, a less volatile portion, and a least volatile portion. Next is allowing the fuel to form a thin layer of fuel with a high surface area to volume ratio on the disc and providing an air stream through the pre-combustion chamber, where the air stream enters the pre-combustion chamber proximate the first surface of the disc and exits the pre-combustion chamber proximate the second surface of the disc, thus allowing a highly volatile portion of the fuel to vaporize and enter the air stream. Next is igniting the fuel in the air stream and allowing the now-hot and burning air stream to heat the second surface of the disc, which in turn heats the fuel still on the first surface, which allows the less volatile portion of the fuel to vaporize and enter the air stream. The final step is allowing the least volatile portion of the fuel to pyrolyze to produce carbon compound solids, which are burned in a solid state until only incombustible ash remains, which incombustible ash is swept from the pre-combustion chamber by the air stream.

Figure 1:
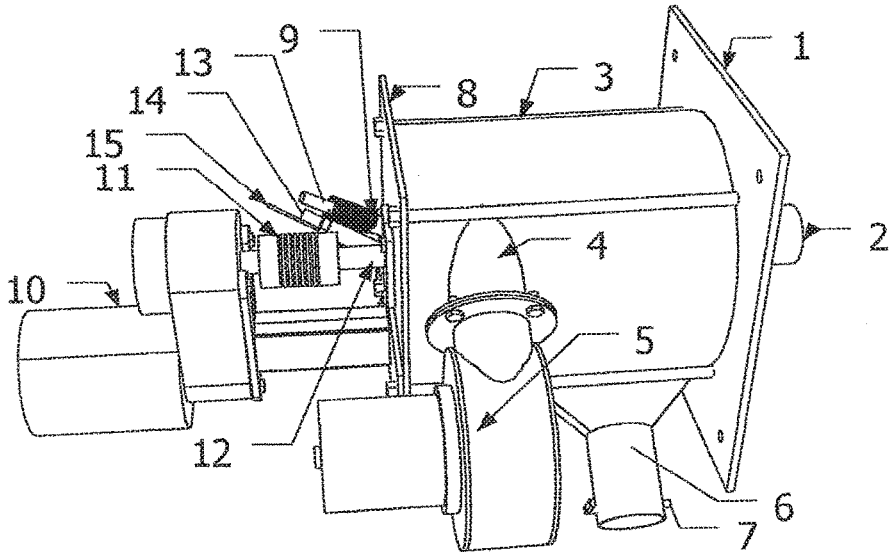
FIG. 1 is a perspective view of the burner.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a waste oil fuel burner. This machine utilizes the adhesive and cohesive properties of liquid fuels to produce the high surface-area to volume ratio of the fuel stock necessary to promote complete combustion. Liquid fuel droplets are not admitted into the combustion air stream in the traditional fashion. Instead, fuel may be applied at low pressure from the sliding contact supply tube to the center of the surface of a slowly rotating vertical disc. As the disc rotates and gravity force pulls the fuel downward, the fuel may thin and spread into an ultra thin film to produce the desired high surface area to volume ratio. The opposite surface of the disc may be heated by combustion products exiting the pre-combustion chamber that surrounds the disc. This heat may vaporize the volatile fraction of the fuel and release it to the airstream for immediate combustion. Fuel that is not readily vaporized may continue to be heated until it either vaporizes or pyrolyzes. Fuel that pyrolyzes to carbon compound solids may be retained in the combustion zone and burned in the solid state. Because no fuel droplets are sprayed into the airstream, complete combustion may be achieved in the reaction zone, and smoke free, soot free flue gases may be created.

Combustion may be completed in two stages. Primary combustion may occur in the pre-chamber around the vaporizer/pyrolyzer disc. This zone may operate at relatively low temperature and fuel rich conditions. The air flow velocities in the pre-combustion chamber may be low and coupled with flow stagnation zones that act as flame holders to produce steady constant combustion characteristics. Flame-outs and sputtering conditions may not exist. Burning gases exiting the pre-chamber may converge and form a tightly constrained vortex onto which secondary combustion air may be wrapped with minimal disturbance to the flame vortex. This may produce a very high temperature secondary combustion zone. The form of this secondary zone flame may be an opaque bright incandescent yellowish white conical vortex. The vortex may have a slight taper from the exit of the pre-chamber to the exit of the secondary air chamber. The secondary air supply may suspend, stabilize, and insulate the flame vortex, which may prolong combustion zone duration and protect the secondary air chamber and flue gas exhaust area from high temperature damage. In addition, the high rotation rate vortex may allow centrifugal separation of ash from the flue gasses inside the burner, which may be swept by the combustion air into an ash reservoir.

FIG. 1 shows an overall perspective of the externally visible components to be used as a reference point for understanding the location of the internal components shown in sectional views in subsequent drawings. The mounting plate 1 may form the frame to which all other components are attached. In the center of the plate 1 may be the exhaust port with the combination exhaust tube 2 and ash deflector lip 19 fitted into it. The air supply plenum 3 may have a tangential flow air supply port 4 to which the combustion blower 5 may be attached. The ash collector 6 and dump valve 7 may also be attached to the air supply plenum 3. Attached to the plenum 3 opposite the mounting plate 1 may be the burner drive-end cover 8 to which may be attached the fuel supply/igniter frame 9 and the pre-combustion chamber drive motor 10. A heat sink shaft coupler 11 may connect the drive motor 10 to the vaporizer/pyrolyzer drive shaft 12. The fuel supply tube 13, silicone nitride hot surface igniter 14, and igniter gas supply tube 15 may fit into the fuel supply/igniter frame 9.

Figure 2:
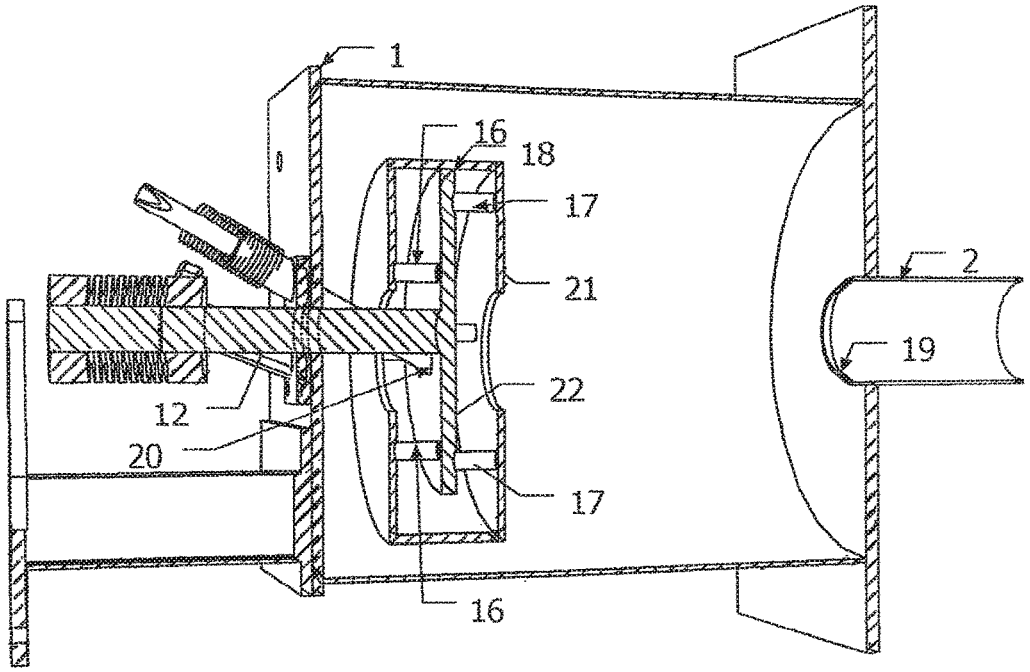
FIG. 2 is a sectional view of the burner.

FIG. 2 shows a sectional view of the entire burner with the viewing plane aligned with the rotational axis of the machine. The drive motor and combustion blower are omitted for clarity. The mounting plate 1, air supply plenum 3, and drive end cover 8 may form the boundaries of the air supply plenum. The vaporizer/pyrolyzer disc 22 may be surrounded by the pre-combustion chamber 21 and both may be carried and rotated by the vaporizer/pyrolyzer disc drive shaft 12. Disc surface scraper pins 16 may be attached to the inlet surface of the pre-chamber 21. Pre-chamber exit surface scraper pins 17 may be attached to the vaporizer/pyrolyzer disc 22. The pre-chamber 21 may not be physically attached to the pyrolyzer disc 22. It may hang from and roll on the upper edge of the disc 18 in an epicyclic fashion, which may cause an orbital and precessional scraping pattern by the scraping pins 16 and 17 that completely and uniformly covers the entire disc surface in a few revolutions of the disc. This feature may prevent channeling the oil off the disc instead of the desired spreading and thinning effect. The scraper pins may also serve to center and guide the pre-chamber as it rolls on the vaporizer disc. In addition, the outermost pins and the disc edge may serve to clean the curved inner surface of the pre-chamber where it contacts the disc. The exhaust tube 2 and its ash deflector lip 19 are shown in the mount plate 1. The fuel supply tube 14 is shown to indicate where the liquid fuel may be applied to the disc at its contact point 20.

Figure 3:
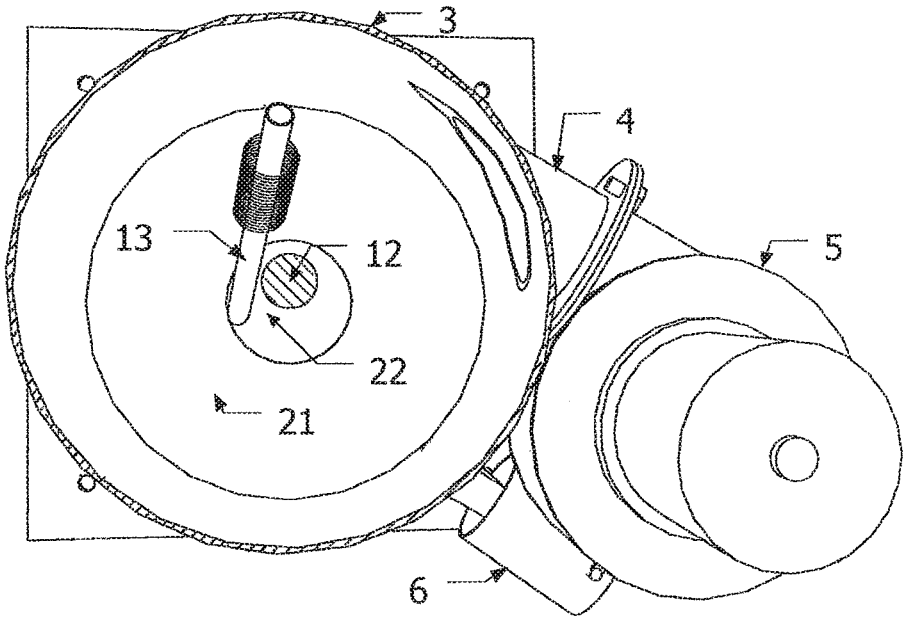
FIG. 3 is an end view of the air plenum.

FIG. 3 shows an end view of the air plenum 3 with the drive end plate and external parts removed to show the location of the combustion blower 5, tangential air supply port 4, pre-combustion chamber 21, vaporizer/pyrolyzer disc 22, drive shaft 12, and fuel supply tube 13. The ash collector 6 is attached to the air plenum 3.

Figure 4:
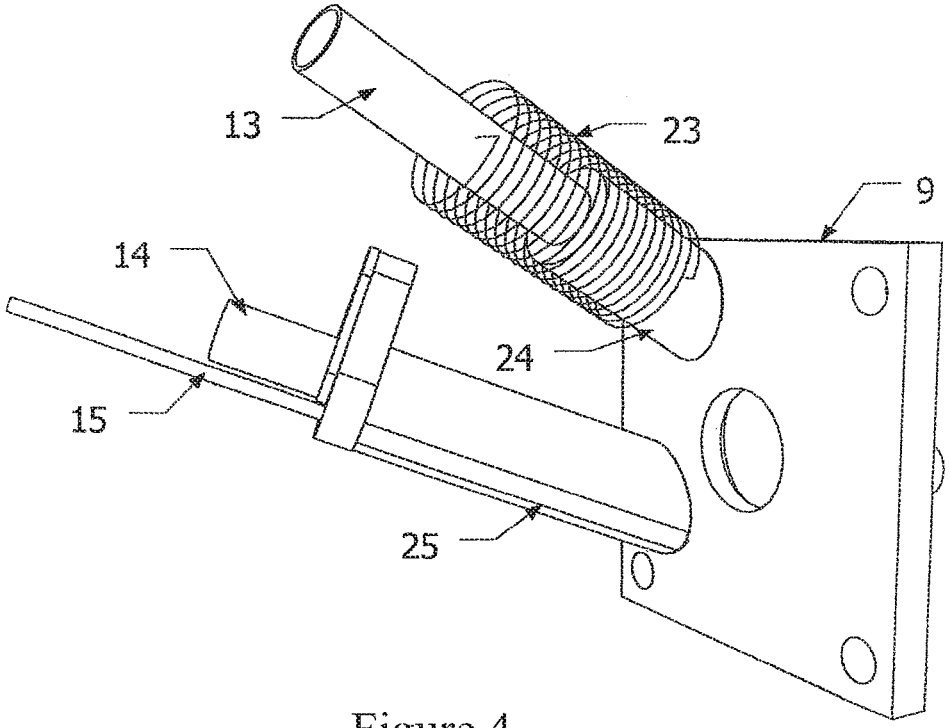
FIG. 4 is a perspective view of the fuel supply/igniter assembly.

FIG. 4 shows detail of the fuel supply/igniter assembly with all associated parts installed. These include the fuel supply/igniter frame 9, fuel supply tube 13 and its tension spring 23, the igniter torch gas nozzle 15, and silicone nitride hot surface igniter 14. The fuel tube 13 may slide through the fuel tube guide 24, and may be loaded against the vaporizer disc by the fuel tube spring 23. The igniter torch gas nozzle 15 and hot surface igniter 14 may be mounted in the igniter torch tube 25.

Figure 5:
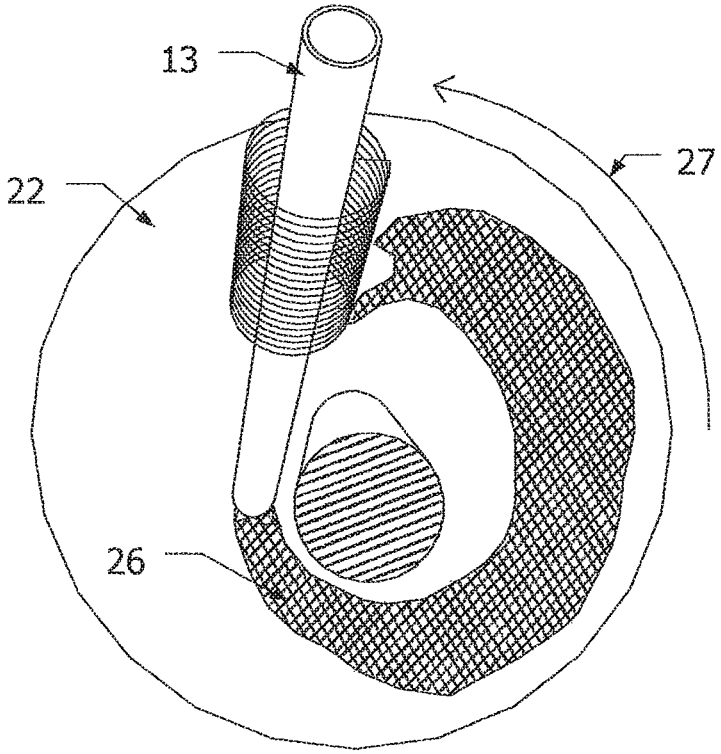
FIG. 5 is a perspective view of the vaporizer/pyrolyzer disc with fuel distributed thereon.

FIG. 5 shows how fuel may be distributed on the vaporizer/pyrolyzer disc 22. Fuel may be applied in rubbing contact from the fuel supply tube 13 to the vaporizer disc 22. The disc may rotate slowly, such as at 8 rpm, so as the fuel 26 is pulled downward on the surface of the disc by gravity force, it may be deflected sideways and upwards by the rotation 27 of the disc 22. The adhesive property of the fuel attaches it to the disc 22 and the cohesive property of the fuel may cause it to stretch into a thin film, which generates the very high surface area to volume ratio necessary for complete efficient combustion. It is this technique of generating the high surface area to volume ratio of the fuel necessary for efficient combustion that allows highly variable quality and/or particulate contaminated fuels to be burned without need for processing or adjustment of the machine. All combustible particulates are burned and all incombustible particulates are burned free of combustible fuel. The burner itself actually processes and cleans the fuel as a function of the combustion process.

Figure 6:
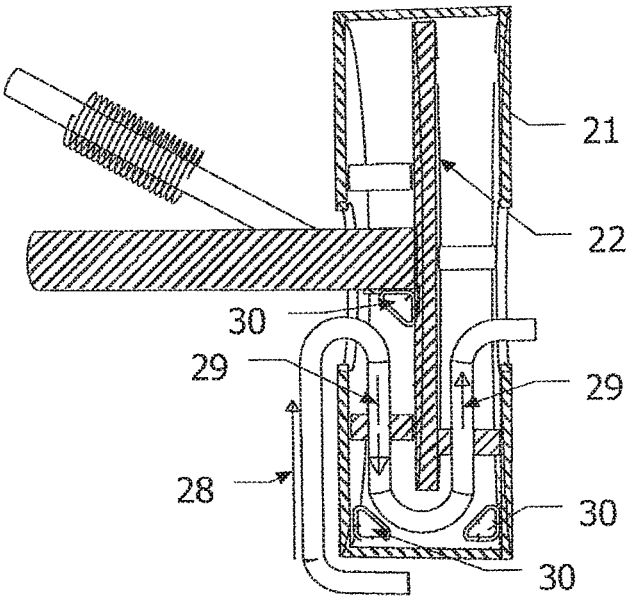
FIG. 6 is a sectional view of a portion of the burner.

FIG. 6 is a sectional view along the axis of rotation of the disc 22 and pre-combustion chamber 21 showing the radial and axial flow components of combustion air 28 and flame 29 inside the pre-combustion chamber. The flow path shown is only a sample section to represent general flow direction. In reality the flow is a sheet of air moving over the outer surface of the pre-chamber toward the pre-chamber inlet. As it enters the pre-chamber it may immediately mix with fuel vapor and ignite becoming flame over the entire volume inside the pre-chamber. Stagnation zones 30 may act as flame holding areas that promote stable combustion. The burning, fuel rich gasses may flow toward the edge of the disc, adding heat to the fuel remaining on the disc then turn back toward the center axis behind the disc before converging at the exit of the pre-combustion chamber. The exiting gasses may also add vaporizing and pyrolyzing heat to the disc. The combined effect of these actions may be a continuous gradation vaporization that begins with light volatile fuel evaporating earliest near the center of the disc by the supply tube contact zone followed by progressively heavier, less volatile fuel vaporizing as it spreads toward the outer edge of the disc. Fuel that cannot vaporize may adhere to the disc and pyrolyze to solid carbon compounds that may be burned to ash in the solid state. A small fraction of fuel may escape the disc before it is burned, but it may be contained by the pre-chamber until it is vaporized or pyrolyzed, and burned to ash which is then swept from the pre-chamber by the exiting combustion gasses. These gasses may be at relatively low temperature (red-orange flame) and very fuel rich, and combustion may be only partially complete. However, all remaining fuel may be thoroughly vaporized and in ideal condition for secondary combustion. The fuel rich carburizing atmosphere in the pre chamber may also serve to prevent oxidation of the disc and pre-chamber. This is the chief operating principle of the machine. It is in essence a self-contained, self-heating refinery that immediately burns its own production.

Figure 7:
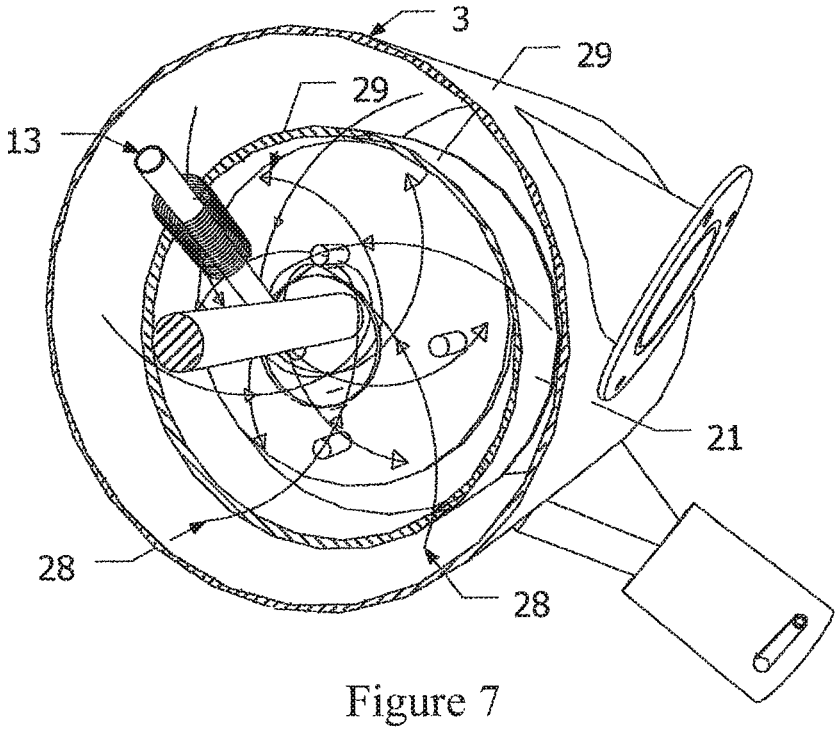
FIG. 7 is an end view of the air plenum.

FIG. 7 is an end view of the air plenum 3, vaporizer disc 22, fuel tube 13, and pre-chamber 21 (with the drive-end cover removed) showing the circumferential flow pattern of the combustion air supply 28 to the pre-chamber and the flame flow 29 inside the pre-chamber before passing behind the vaporizer/pyrolyzer disc 22.

Figure 8:
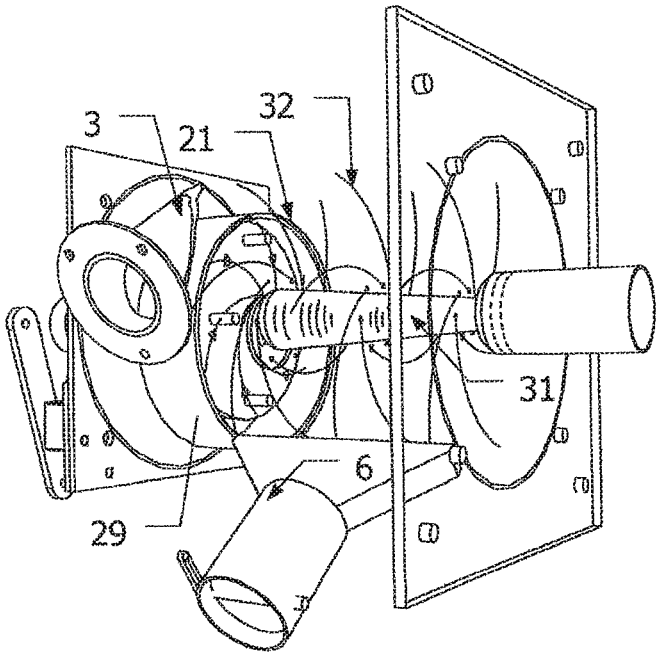
FIG. 8 is a sectional view of the burner.

FIG. 8 is a view of the air plenum 3 and outlet of the pre-chamber 21. It shows the hot fuel-rich combustion gasses 29 converging to the outlet of the pre-chamber and forming into a tightly confined, high-temperature secondary combustion vortex 31 onto which secondary combustion air 32 is gently and uniformly wrapped. Ash particles may be ejected by centrifugal action from the rapidly rotating flame vortex and move out to the air plenum where they may be swept into the ash collector 6 by the combustion air. The cool combustion air solidifies any potentially molten ash before it can solidify into a solid mass with other ash particles. This ash cooling effect allows vortex temperature to remain high (2200+F) without the ash solidification problems normally associated with these temperatures. The clean combustion air circulating in the air plenum may completely surround all combustion gasses and high temperature components until the flue gasses leave the burner. This may yield seven desired functions: the entire outer surface of the burner may remain at safe temperatures below 350 F, the pre-combustion chamber may be cooled below oxidizing temperatures on its outer surface for protection from degradation, the pre-combustion supply air may be heated enhancing vaporization and primary combustion, all combustion gasses may be surrounded by supply air and forced inward to the center axis of the burner preventing any combustion gas escape from the burner except through the exhaust port, the secondary combustion vortex may be fed, stabilized, confined, and insulated by the combustion supply air keeping the burning gasses confined for sufficient temperature and time with uniformly and gently supplied air to effect complete combustion, the ratio of pre-combustion air to secondary-combustion air may be self-proportioning from a single source, and excess combustion air can be supplied without harmful dilution of the combustion process ensuring that more than enough air is available to complete combustion.

Figure 9:
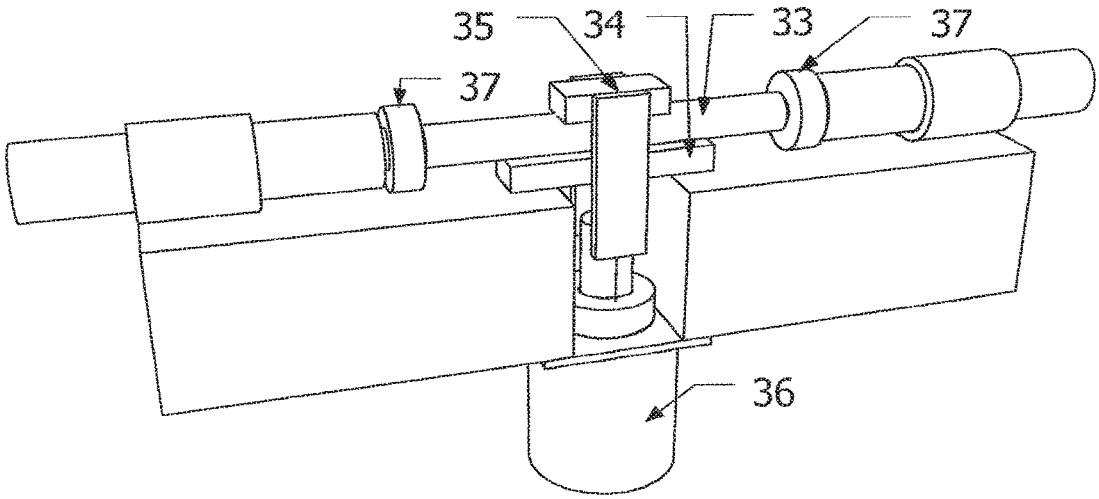
FIG. 9 is a perspective view of the pump.

FIG. 9 shows a pulsed flow peristaltic pump used to regulate fuel flow to the burner. It combines the principles of a diaphragm pump and peristaltic pump to enable precise flow regulation of particulate laden and variable viscosity fuels. Peristaltic tubing 33 may be squeezed between a fixed platen 34 and a driven platen 35 by an electrical solenoid 36. Two check valves 37 may establish directional flow. The large flow area of the tubing and check valves relative to the flow rate, coupled with the pulsating flow, may serve to prevent clogging by contaminant particles and high viscosity flow restriction. By controlling the pulsation rate with an external timer circuit, precisely controlled flow rates may be achieved. Adjusting the pulsation rate with the timer circuit controls the flow rate. The output rate of the burner may be adjusted in this way with no other controls or adjustments necessary.

Figure 10:
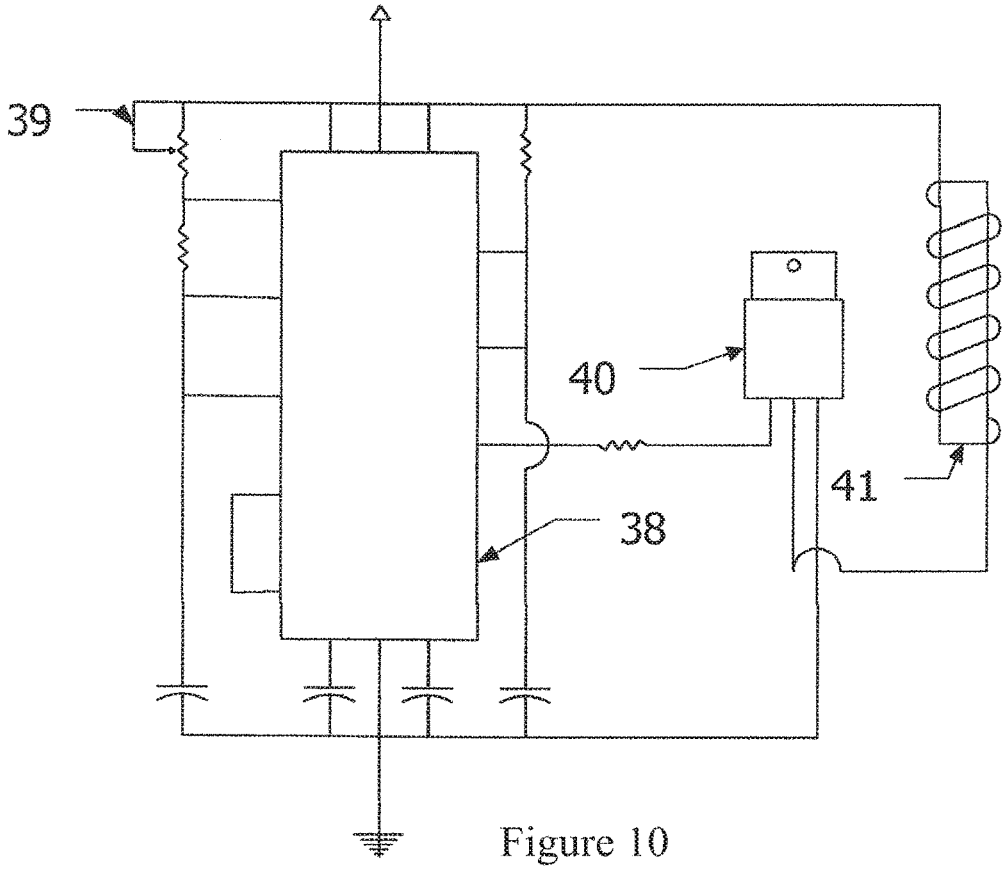
FIG. 10 is a schematic view of the pump circuitry.

FIG. 10 shows the control circuit for the pulse peristaltic pump. A 556 timer IC 38 may establish the driving current pulse length and frequency. The frequency may be adjusted by potentiometer 39. The output current may be switched by a mosfet 40. The pulse peristaltic pump drive solenoid is 41. The pulse rate may be adjustable from 0.25 to 4.0 pulses per second.

Figure 11:
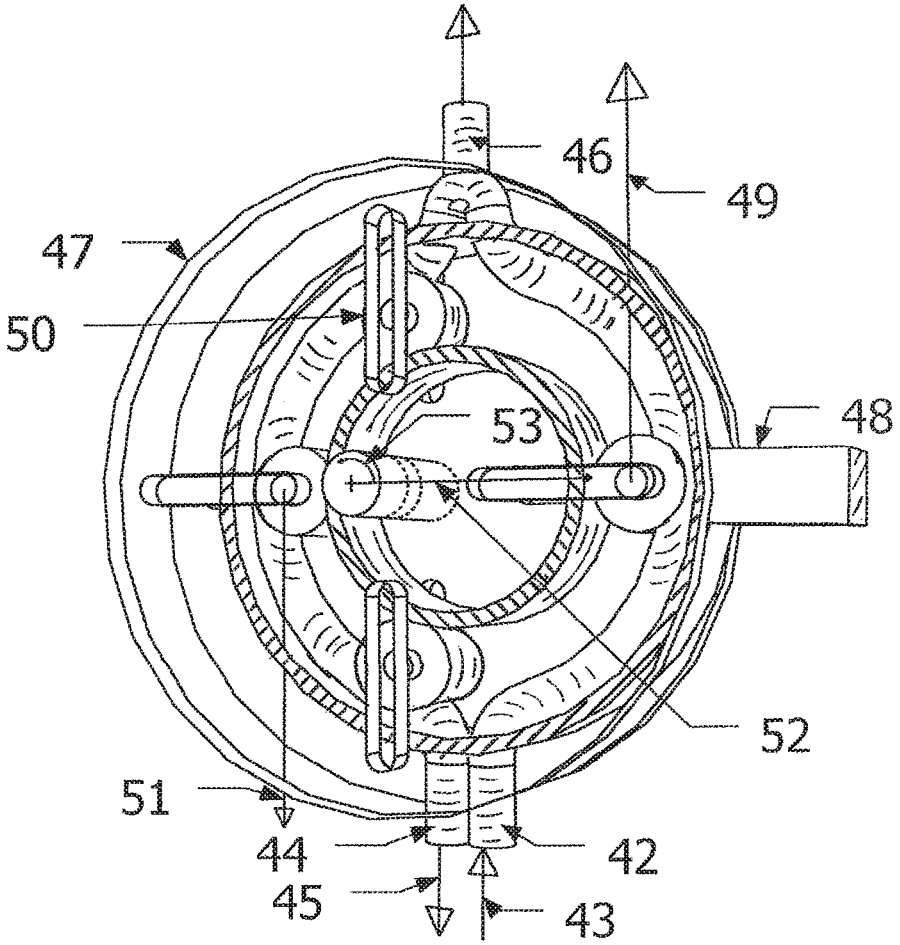
FIG. 11 is a sectional view of the pump.

FIG. 11 shows a variable volume differential controlled peristaltic pump. This design is desirable to fuel larger burners requiring higher flow rates and fuels with larger contaminant particles, or slurried fuels with very high viscosity. It may operate as a duplex peristaltic pump with one section of tubing 42 acting in the supply direction 43 and the other section of tubing 44 operating the return direction 45. The combined supply and return flows may produce a differential flow 46 that is then sent to the burner. By varying the location of the slotted driving member 47 relative to the center axis of the roller case 48, the velocities 49 of the rollers 50 on the supply side can be increased while the return rollers' velocities 51 are decreased. This is caused by the changing radius of the driving point 52 relative to the axis of rotation of the driving member. When the driving axis is central to the roller case, the supply volume equals the return volume and the net flow rate to the burner is the difference, or zero. However, the total volume rate through the pump is constant and high. These desired effects are the result of this design; the pump is rapidly self-priming, very viscous fluids with large particles can be pumped with very high accuracy without clogging, slurried fuels are constantly agitated to prevent settling of the entrained particulates, the flow rate is precisely and continuously adjustable, the pump can be driven by the burner shaft motor which has the desirable high-torque and constant low shaft speed for this pump, and the pump stops if the drive motor stops.

The versatility and reliability of peristaltic type pumps in handling a wide range of fuel chemistries is also highly desirable for the fuel pumping requirements of this burner design.

Figure 12:
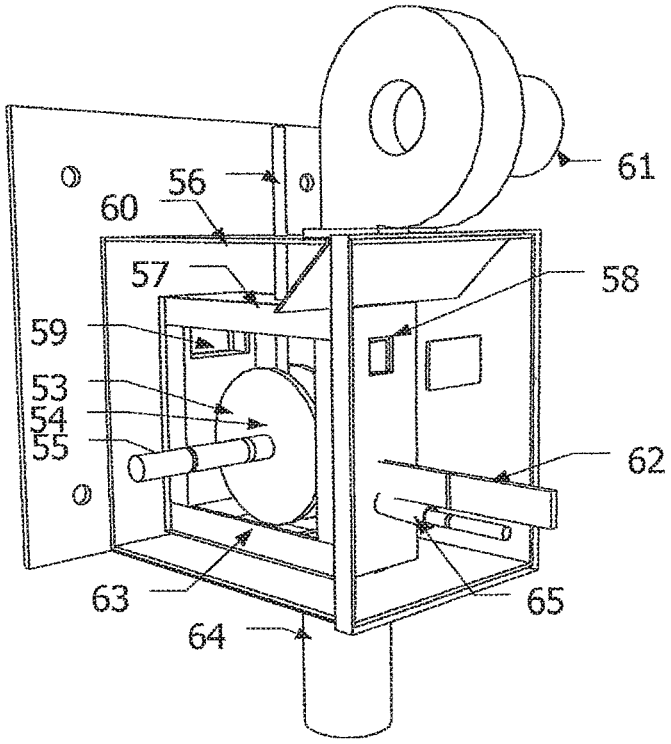
FIG. 12 is a perspective view of an alternate design of the pump.

FIG. 12 is an alternate transverse rotation axis burner design that operates on the same vaporizer/pyrolyzer disc principle. In this design, two vaporizer discs 53 separated by a v-shaped spool 54 rotate at low speed away from the supply air on an axle 55 perpendicular to the primary air flow in the burner. Fuel may be applied by the fuel tube 56 kept in rubbing contact with the v-spool. The spool may serve to distribute oil to the inner surface of both discs. Air flow in the combustion chamber 57 may enter through a fixed nozzle 58 aimed between the discs above the v-spool, toward but slightly below the exhaust port 59 of the burner. Part of the airflow, now mixed with fuel vapor from the discs, may return around the bottom of the discs and ignite. This burning fuel rich flow may divide and pass around the outer side of the discs, providing heat for vaporization and pyrolyzation of the fuel on the inside surfaces of the discs. This burning flow may converge and mix with the main clean air flow exiting the burner and create two secondary combustion vortices in the exhaust port. The entire combustion chamber may be surrounded by an air supply plenum 60 and air from the combustion blower 61 may be circulated around the combustion chamber to cool it and pre-heat the air. Disc maintenance and ash collection may be accomplished by a disc scraper 62 and the rotation of the discs. Ash may fall to the bottom tray 63 of the combustion chamber, be dragged by the discs over the edge of the tray, and fall into the ash reservoir 64. Ignition is performed by a gas torch 65 located below the scraper firing between the discs below the v-spool.

Figure 13:
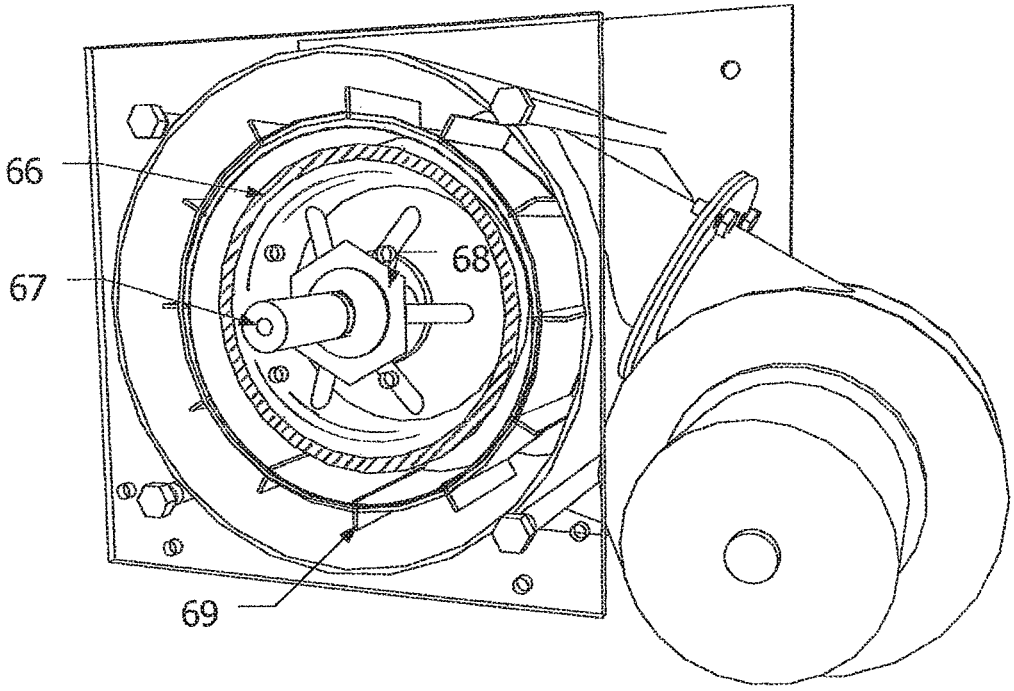
FIG. 13 is a perspective view of an alternate design of the burner.

FIG. 13 is an axial rotation primary combustion chamber version combining a centrifugal cup with the vaporizer/pyrolyzer disc principle to allow use in moving and/or non-horizontal axis conditions. The vaporizer/pyrolyzer/centrifuge cup 66 may spin at sufficient speed to hold the fuel to the surface under any acceleration the machine might experience. Fuel may be fed to the bottom of the cup through the hollow cup shaft 67 and spread, thin, and vaporize, now assisted by centrifugal action. The pre-combustion chamber may be mounted on bearings 68 on the drive shaft, on which it free rotates. Scrapers may be mounted on the pre-chamber to maintain the surface inside the cup, and scrapers may be mounted on the cup to maintain the outlet surface of the pre-chamber. The pre-chamber may turn at reduced speed from the cup, restrained by air vanes 69 on the outer surface of the pre-chamber, which may drag on the combustion supply air. This generates the speed difference necessary to maintain the cleaning action of the cup and disc surfaces. All other functions are substantially the same as the stationary axial flow design. A hollow core version of this variation is proposed for use as a multi-fuel combustion chamber for Brayton cycle axial flow turbine engines (jet engines).

Whereas, the devices and methods have been described in relation to the drawings and claims, it should be understood that other and further modifications, apart from those shown or suggested herein, may be made within the spirit and scope of this invention.

What is claimed is:

1. A liquid fuel burner comprising:

a plenum;

a pre-combustion chamber housing surrounding a pre-combustion chamber, where the pre-combustion chamber housing is located within the plenum;

a disc located within the pre-combustion chamber housing, where the disc has a first surface, an opposing second surface, an edge, and a center;

a drive shaft extending into the plenum upon which the pre-combustion chamber housing and the disc are mounted, allowing the pre-combustion chamber housing and the disc to rotate within the plenum;

a fuel supply tube located such that the fuel supply tube is capable of applying liquid fuel to the first surface of the disc near the center of the disc; and an igniter.

2. The burner of claim 1 further comprising a combustion blower attached to the plenum via a tangential flow air supply port.

3. The burner of claim 1 further comprising an ash collector and dump valve, where the ash collector is attached to the plenum.

4. The burner of claim 1 further comprising a mounting plate attached to a first end of the plenum and a drive end cover attached to an opposing second end of the plenum.

5. The burner of claim 4 where the mounting plate has an exhaust port comprising a combination exhaust tube and ash deflector.

6. The burner of claim 4 where the drive shaft and fuel supply tube extend through the drive end cover.

7. The burner of claim 6 where a fuel supply frame and a drive motor are attached to the drive end cover, such that the drive shaft attaches to the drive motor via a heat sink shaft coupler and the fuel supply tube, the igniter, and an igniter gas supply tube fit into the fuel supply frame.

8. The burner of claim 1 where the igniter is a silicone nitride hot surface igniter.

9. The burner of claim 1 where the pre-combustion chamber housing is not physically attached to the disc such that it hangs from and rolls on the edge of the disc in an epicyclic fashion.

10. The burner of claim 9 where the pre-combustion chamber housing further comprises a plurality of disc surface scraper pins extending toward the first surface of the disc such that the pins cause an orbital and precessional scraping pattern that completely and uniformly covers the first surface of the disc when the disc when the disc is rotated.

11. The burner of claim 1 where the disc further comprises a plurality of pre-combustion chamber scraper pins extending from the second surface of the disc.

12. The burner of claim 1 where the fuel supply tube is attached to a pulsed flow peristaltic pump comprising peristaltic tubing squeezed between a fixed platen and a driven platen by an electric solenoid and two check valves establishing directional flow.

13. A method of combusting liquid fuel, the method comprising:

rotating a vertical disc located within a pre-combustion chamber housing surrounding a pre-combustion chamber, where the disc has a first surface and an opposing second surface and the pre-combustion chamber housing is located within a plenum;

applying fuel to the first surface of the disc near the center, where the fuel comprises a highly volatile portion, a less volatile portion, and a least volatile portion;

allowing the fuel to form a thin layer of fuel with a high surface area to volume ratio on the disc;

providing an air stream through the pre-combustion chamber, where the air stream enters the pre-combustion chamber proximate the first surface of the disc and exits the pre-combustion chamber proximate the second surface of the disc;

allowing a highly volatile portion of the fuel to vaporize and enter the air stream;

igniting the fuel in the air stream;

allowing the now-hot and burning air stream to heat the second surface of the disc, which in turn heats the fuel still on the first surface, which allows the less volatile portion of the fuel to vaporize and enter the air stream;

allowing the least volatile portion of the fuel to pyrolyze to produce carbon compound solids, which are burned in a solid state until only incombustible ash remains, which incombustible ash is swept from the pre-combustion chamber by the air stream.

* * * * *